US005545237A

United States Patent [19]

Habeeb et al.

[11] Patent Number: 5,545,237

[45] Date of Patent: Aug. 13, 1996

[54] SMOKE REDUCING ADDITIVE FOR TWO-CYCLE ENGINE FUEL MIXTURE

[75] Inventors: Jacob J. Habeeb, Westfield, N.J.; Christopher J. May, Sarnia, Canada

[73] Assignee: Exxon Research and Engineering Company, Florham Park, N.J.

[21] Appl. No.: 530,491

[22] Filed: Sep. 19, 1995

Related U.S. Application Data

[63] Continuation of Ser. No. 272,707, Jul. 8, 1994, abandoned.

[51] Int. Cl.[6] ..... C10L 1/26

[52] U.S. Cl. ..... 44/380; 44/381; 44/459

[58] Field of Search ..... 44/380, 381

[56] References Cited

U.S. PATENT DOCUMENTS

| | | | |
|---|---|---|---|
| 2,863,742 | 12/1958 | Cantrell et al. | 44/58 |
| 3,002,014 | 9/1961 | Dinsmore et al. | 260/461 |
| 3,228,758 | 1/1966 | Bauer | 44/380 |
| 3,384,466 | 5/1968 | Popkin | 44/380 |
| 3,460,923 | 8/1969 | Dorer, Jr. | 44/380 |
| 3,509,240 | 4/1970 | Popkin | 44/380 |
| 3,652,242 | 3/1972 | Andress, Jr. et al. | 44/380 |
| 3,703,360 | 11/1972 | Perilstein | 44/381 |
| 3,807,976 | 4/1974 | Polss | 44/380 |
| 3,835,029 | 9/1974 | Larson | 208/113 |
| 3,880,613 | 4/1975 | Oswald et al. | 44/380 |
| 3,909,214 | 9/1975 | Polss | 44/380 |
| 3,951,829 | 4/1976 | Mullen et al. . | |
| 3,997,454 | 12/1976 | Adams | 252/18 |
| 4,101,427 | 7/1978 | Shaub | 252/32.7 |
| 4,250,045 | 2/1981 | Coupland et al. | 252/32.7 |
| 4,575,431 | 3/1986 | Salentine | 252/32.7 |
| 4,720,288 | 1/1988 | Croudace et al. | 44/380 |
| 4,721,802 | 1/1988 | Forzberg | 588/207 |
| 4,759,860 | 7/1988 | Tanaka | 252/32.5 |
| 5,076,945 | 12/1991 | Habeeb et al. | 252/47.5 |
| 5,092,908 | 3/1992 | Feldman et al. | 44/380 |
| 5,094,666 | 3/1992 | Feldman et al. | 44/388 |

OTHER PUBLICATIONS

Harrison, et al., Wear, 116 (1987) 25–31, month N/A.

Rounds, "Some Effects of Amines on Zinc Dialkyldithiophosphate Antiwear Performance as Measured in 4–Ball Wear Tests," ASLE Trans., 24 (4), 431–440, month N/A.

*Primary Examiner*—Ellen M. McAvoy

*Attorney, Agent, or Firm*—John J. Mahon

[57] ABSTRACT

A fuel mixture containing an ionic complex of an amine salt of a phosphoric acid is effective in reducing the smoke emitted during operation of a two-cycle internal combustion engine. A preferred phosphoric acid derivative is dioctyldithiophosphate. A preferred primary amine component is dihydrogenated tallow amine.

17 Claims, No Drawings

SMOKE REDUCING ADDITIVE FOR TWO-CYCLE ENGINE FUEL MIXTURE

This is a continuation of application Ser. No. 08/272,707, filed Jul. 8, 1994, now abandoned.

BACKGROUND OF THE INVENTION

1. Field of the Invention

This invention relates to a fuel mixture for two-cycle internal combustion engines in which the mixture has reduced smoke emission due to the presence of a hydrocarbyl substituted primary amine salt of a derivative of phosphoric acid.

2. Description of Related Art

In the last several years, the use of spark-ignited two-cycle internal combustion engines has increased significantly. This is due to their use in a variety of garden and recreational equipment such as motorcycles, marine outboard engines, snowmobiles, power mowers, snow blowers, chain saws, and the like. As such, the amount of smoke released from two-cycle engines has become a major environmental concern to engine manufacturers and fuel suppliers. However, few smoke reducing additives are commercially available, and the few that are contain metals which are environmentally undesirable.

More recently, the use of additives of this invention as an antioxidant in lubricating oils and as a flow improve in middle distillates has been disclosed in applications U.S. Ser. Nos. 582,316, now U.S. Pat. No. 5,076,945, and U.S. Ser. No. 545,002, now U.S. Pat. No. 5,094,666, respectively.

However, none of these publications suggest the particular additive for the two-cycle engine fuel mixture disclosed herein or its effectiveness in reducing the smoke formed during combustion of the mixture.

SUMMARY OF THE INVENTION

This invention concerns a two-cycle engine fuel mixture that comprises (a) a lubricating oil basestock, (b) a distillate fuel, and (c) an ionic complex of an oil and fuel-soluble hydrocarbyl substituted amine salt of a dithiophosphoric acid having the formula:

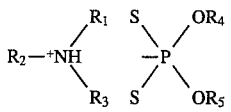

wherein, $R_1$, $R_2$ and $R_3$ are the same or different and are selected from the group consisting of hydrogen, a hydrocarbyl group and a hydrocarbyl substituted group, with $R_1$, $R_2$ and $R_3$ each having a total of from 2 to 30 carbon atoms, wherein the hydrocarbyl group is preferably an alkyl group and the hydrocarbyl substituted group is preferably an alkyl group containing nitrogen, sulfur or oxygen, representing such groups as a carbinol, thio, amine, amide, ester, ether, etc.;

$R_4$ and $R_5$ are selected from hydrogen and a hydrocarbyl group containing from 1 to 28 carbon atoms, preferably an alkyl group containing from 4 to 12 carbon atoms, and at least one of the radicals $R_4$ or $R_5$ is a hydrocarbyl, preferably an alkyl group, group containing from 3 to 18 carbon atoms.

In another embodiment, this invention concerns a fuel mixture which comprises (a) a lubricating oil basestock, (b) a distillate fuel, and (c) an ionic complex of an oil and fuel-soluble hydrocarbyl substituted amine salt of an oil and fuel-soluble dithiophosphoric acid prepared by reacting an amine having the formula:

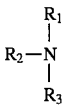

wherein, $R_1$, $R_2$ and $R_3$ are the same or different and are selected from the group consisting of hydrogen, a hydrocarbyl group and a hydrocarbyl substituted group, with $R_1$, $R_2$ and $R_3$ each having a total of from 2 to 30 carbon atoms, wherein the hydrocarbyl group is preferably an alkyl group and the hydrocarbyl substituted group is preferably an alkyl group containing nitrogen, sulfur or oxygen, representing such groups as a carbinol, thio, amine, amide, ester, ether, etc.; with a dithiophosphoric acid having the formula:

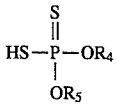

wherein $R_4$ and $R_5$ are selected from hydrogen and a hydrocarbyl group containing from 1 to 28 carbon atoms, preferably an alkyl group containing from 4 to 12 carbon atoms, and at least one of the radicals $R_4$ or $R_5$ is a hydrocarbyl, preferably an alkyl group, group containing from 3 to 18 carbon atoms, at an ionic salt forming temperature of not less than 85° C., preferably from 85° C. to 140° C., for a time sufficient for the amine and the dithiophosphoric acid to react and form an ionic salt.

In yet another embodiment, this invention concerns a method for reducing smoke emission from a two-cycle internal combustion engine by operating the engine with the fuel mixture described above.

DETAILED DESCRIPTION OF THE INVENTION

In general, the two-cycle engine fuel mixture of this invention requires a lubricating oil basestock, a distillate fuel, and an ionic complex of an amine salt of a phosphoric acid derivative. However, if desired, other lubricant and distillate fuel additives may be present in the mixture as well.

The lubricating oil basestock can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g. dodecylbenzenes, tetradecylbenzenes, dinonylbenzenes, di(2-ethylhexyl)benzene, etc.); polyphenyls (e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl alonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerylthritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hexa-(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

If desired, other additives known in the art may be added to the lubricating base oil. Such additives include dispersants, antiwear agents, antioxidants, corrosion inhibitors, detergents, pour point depressants, extreme pressure additives, viscosity index improvers, friction modifiers, and the like. These additives are typically disclosed, for example, in "Lubricant Additives" by C. V. Smalhear and R. Kennedy Smith, 1967, pp. 1–11 and in U.S. Pat. No. 4,105,571, the disclosures of which are incorporated herein by reference.

The distillate fuels used in two-cycle engines are well known to those skilled in the art and usually contain a major portion of a normally liquid fuel such as hydrocarbonaceous petroleum distillate fuel (e.g., motor gasoline as defined by ASTM Specification D-439-73). Such fuels can also contain nonhydrocarbonaceous materials such as alcohols, ethers, organo-nitro compounds and the like (e.g. methanol, ethanol, diethyl ether, methyl ethyl ether, nitromethane), are also within the scope of this invention as are liquid fuels derived from vegetable or mineral sources such as corn, alfalfa, shale, and coal. Examples of such fuel mixtures are combinations of gasoline and ethanol, diesel fuel and ether, gasoline and nitromethane, etc. Particularly preferred is gasoline, that is, a mixture of hydrocarbons having an ASTM boiling point of 60° C. at the 10% distillation point to about 205° C. at the 90% distillation point.

Two-cycle fuels may also contain other additives which are well known to those skilled in the art. These can include anti-knock agents such as tetra-alkyl lead compounds, lead scavengers such as halo-alkanes (e.g., ethylene dichloride and ethylene dibromide), dyes, cetane improvers, anti-oxidants such as 2,6-di-tertiary-butyl-4-methylphenol, rust inhibitors such as alkylated succinic acids and anhydrides, bacteriostatic agents, gum inhibitors, metal deactivators, demulsifiers, upper cylinder lubricants, anti-icing agents, and the like. This invention is useful with lead-free as well as lead containing fuels.

The fuel mixture of this invention will also contain an ionic complex of an oil and fuel-soluble hydrocarbyl substituted amine salt of a dithiophosphoric acid having the formula:

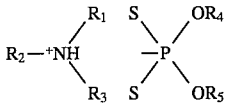

wherein, $R_1$, $R_2$ and $R_3$ are the same or different and are selected from the group consisting of hydrogen, a hydrocarbyl group and a hydrocarbyl substituted group, with $R_1$, $R_2$ and $R_3$ each having a total of from 2 to 30 carbon atoms, wherein the hydrocarbyl group is preferably an alkyl group and the hydrocarbyl substituted group is preferably an alkyl group containing nitrogen, sulfur or oxygen, representing such groups as a carbinol, thio, amine, amide, ester, ether, etc.;

$R_4$ and $R_5$ are selected from hydrogen and a hydrocarbyl group containing from 1 to 28 carbon atoms, preferably an alkyl group containing from 4 to 2 carbon atoms, and at least one of the radicals $R_4$ or $R_5$ is a hydrocarbyl, preferably an alkyl group, group containing from 3 to 18 carbon atoms.

The amine salt is ionic in character and is formed by reacting an amine having the formula:

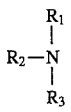

wherein, $R_1$, $R_2$ and $R_3$ are the same or different and are selected from the group consisting of hydrogen, a hydrocarbyl group and a hydrocarbyl substituted group, with $R_1$, $R_2$ and $R_3$ each having a total of from 2 to 30 carbon atoms, wherein the hydrocarbyl group is preferably an alkyl group and the hydrocarbyl substituted group is preferably an alkyl group containing nitrogen, sulfur or oxygen, representing such groups as a carbinol, thio, mine, amide, ester, ether, etc.; with a dithiophosphoric acid having the formula:

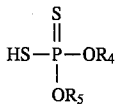

wherein $R_4$ and $R_5$ are selected from hydrogen and a hydrocarbyl group containing from 1 to 28 carbon atoms, preferably an alkyl group containing from 4 to 12 carbon atoms, and at least one of the radicals $R_4$ or $R_5$ is a hydrocarbyl, preferably an alkyl group, group containing from 3 to 18 carbon atoms, at an ionic salt forming temperature of not less than 85° C., preferably from 85° C. to 140° C., for a time sufficient for the amine and the dithiophosphoric acid to react and form an ionic salt.

The preferred amines include naturally occurring amines, which are generally mixtures. Examples include coco amines derived from coconut oil which is a mixture of primary amines having straight chain alkyl groups ranging from $C_8$ to $C_{18}$. Another example is tallow amine, derived from hydrogenated tallow acids, which has a mixture of $C_{14}$ to $C_{18}$ straight chain alkyl groups. Tallow amine is particularly preferred.

Specific examples of the phosphoric acid derivative include dioctyldithiophosphoric acid; dihexyldithiophosphoric acid; dibutyldithiophosphoric acid; didodecylphenyldithiophosphoric acid; dioctylphosphoric acid; butylhexyldithiophosphoric acid; butyloctyldithiophosphoric acid; and the like.

Oil and fuel-soluble, as used herein, means that the additive is soluble in the mixture at ambient temperatures, e.g., at least to the extent of about 5 wt. % additive in the mixture at 25° C.

It is the ionic character of the amine salt that distinguishes the smoke reducing additive of this invention. The smoke reducing additive is formed by reacting the amine with the dithiophosphoric acid at an ionic salt forming temperature of not less than about 85° C., preferably about 95° C., until the amine and dithiophosphoric acid form an ionic salt. It is to be understood that the ionic salt will form under a wide range of ionic salt forming temperatures. Below this range, the ionic character is not adequate, and above this range degredation occurs. Preferably, the reaction temperature will not be above 140° C., more preferably 120° C.

Ionic bonding can be determined by those of ordinary skill in the art using any appropriate analytical means. For example, $^{31}$P-nuclear magnetic resonance can be used to measure the chemical shift exhibited by the smoke reducing compound.

As is well known to those skilled in the art, two-cycle engine lubricating oils are often added directly to the fuel to form a mixture of oil and fuel which is then introduced into the engine cylinder. Such fuel blends generally contain per 1 part of oil about 20–250 parts fuel, typically they contain 1 part oil to about 30–100 parts fuel.

The amount of additive in the mixture can vary broadly depending on the fuel mixture ratio. Accordingly, only an amount effective in reducing the smoke of the mixture need be added. In practice, however, the amount of additive added will range from about 0.1 to about 5, preferably from about 0.5 to about 1 wt. %, based on weight of lubricant in the fuel mixture.

The invention will be further understood by reference to the following Examples, which include preferred embodiments of the invention.

EXAMPLE 1

589 g dihydrogenated tallow amine was placed in a 5-neck 1000 ml round-bottom flask fitted with a condenser, a thermometer, a pH electrode and a nitrogen gas bubbler. The amine was stirred and heated to 70° C. At that temperature, a stoichiometric amount of diidooctyldithiophosphoric acid (400 g) was titrated into the acid (about 8 minutes). The temperature increased to 94° C. due to the exothermic acid/base interaction and was raised and maintained at 108° C. for two hours. The pH of the mixture was constantly monitored throughout the reaction and maintained at pH 7. Nitrogen gas was bubbled during this procedure to maintain a neutral (non-oxidative) environment and to drive out any $H_2O$ formed during the reaction, since the presence of water causes the hydrolysis of the salt to the starting materials

EXAMPLE 2

350 g of ethoxylated(5)cocoalkylamine was placed in a 5-neck 1000 ml round-bottom flask fitted with a condenser, a thermometer, a pH electrode and a nitrogen gas bubbler. The amine was stirred and heated to 70° C. At that temperature, a stoichiometric amount of diidooctyldithiophosphoric acid (295 g) was titrated into the acid (about 8 minutes). The temperature increased to 94° C. due to the exothermic acid/base interaction and was raised and maintained at 108° C. for two hours. The pH of the mixture was constantly monitored throughout the reaction and maintained at pH 7. Nitrogen gas was bubbled during this procedure to maintain a neutral (non-oxidative) environment and to drive out any $H_2O$ formed during the reaction, since the presence of water causes the hydrolysis of the salt to the starting materials.

EXAMPLE 3

Three samples of the same fuel mixture were tested in a single cylinder Yamaha snowmobile engine to determine the maximum smoke produced by each sample. The mixture comprised a commercially available two-cycle engine lubricating oil and a commercially available unleaded gasoline having a RON of 91 and an oil to fuel ratio of 1 to 33. The samples tested were the fuel mixture without additives, the mixture with a conventional smoke reducing additive (barium sulfonate), and the mixture with an additive made according to the procedure of Example 1 (DTA:DDP=

Dihydrogenated tallow amine:Dioctyldithiophosphate). The maximum smoke produced when operating the engine at 4500 rpm and applying a 10 Nm (Newton meter) load was measured by inserting an optical opacity smokemeter into the exhaust system. The results obtained are shown in Table 1.

TABLE 1

| Test No. | Additive | Cone, wt. % | Max. Smoke, % | Smoke Reduction, % |
|---|---|---|---|---|
| 1 | None | — | 49.6 | — |
| 2 | DTA:DDP | 1.0 | 41.2 | 17 |
| 3 | Ba Sulfonate | 1.0 | 39.8 | 20 |

The data in Table 1 show that the additives of this invention provide a reduction in smoke comparable with that of barium sulfonate (a commercially available additive) without the formation of ash.

Having now fully described this invention, it will be appreciated by those skilled in the art that the invention can be performed within a wide range of parameters within what is claimed.

What is claimed is:

1. A fuel mixture for two-cycle engines having reduced smoke emission properties consisting essentially of (a) a mineral lubricating oil basestock, (b) a motor gasoline and (c) an ionic complex of an oil and fuel-soluble hydrocarbyl substituted amine salt of a dithiophosphoric acid having the formula:

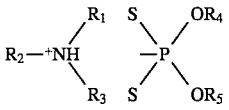

wherein, $R_1$, $R_2$ and $R_3$ are the same or different and are selected from the group consisting of hydrogen, a hydrocarbyl group and a hydrocarbyl substituted group, with $R_1$, $R_2$ and $R_3$ each having a total of from 2 to 30 carbon atoms, $R_4$ and $R_5$ are selected from hydrogen and a hydrocarbyl group containing from 1 to 28 carbon atoms, and at least one of the radicals $R_4$ or $R_5$ is a hydrocarbyl group containing from 3 to 18 carbon atoms.

2. The fuel mixture of claim 1, wherein the hydrocarbyl groups are alkyl groups.

3. The fuel mixture of claim 1, wherein the hydrocarbyl substituted group is an alkyl group containing nitrogen, sulfur or oxygen.

4. The fuel mixture of claim 3, wherein the alkyl group containing nitrogen, sulfur or oxygen contains a carbinol, thio, amine, amide, ester or ether group.

5. The fuel mixture of claim 2, wherein $R_4$ and $R_5$ are selected from hydrogen and an alkyl group containing from 4 to 12 carbon atoms.

6. The fuel mixture of claim 1, comprising 0.1 to 5 wt. % of the oil-soluble additive.

7. The fuel mixture of claim 1, comprising a volume ratio of oil to fuel ranging from 1:20 to 1:250.

8. A method for reducing smoke emitted from a two-cycle internal combustion engine by operating the engine with the mixture of claim 1.

9. A fuel mixture for two-cycle engines having reduced smoke emission properties consisting essentially of (a) a mineral lubricating oil basestock, (b) a motor gasoline, and (c) an ionic complex of an oil and fuel-soluble hydrocarbyl substituted amine salt of an oil and fuel-soluble dithiophosphoric acid prepared by reacting an amine having the formula:

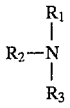

wherein, $R_1$, $R_2$ and $R_3$ are the same or different and are selected from the group consisting of hydrogen, a hydrocarbyl group and a hydrocarbyl substituted group, with $R_1$, $R_2$ and $R_3$ each having a total of from 2 to 30 carbon atoms;

with a dithiophosphoric acid having the formula:

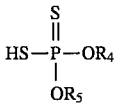

wherein $R_4$ and $R_5$ are selected from hydrogen and hydrocarbyl group containing from 1 to 28 carbon atoms, and at least one of the radicals $R_4$ and $R_5$ is a hydrocarbyl group containing from 3 to 18 carbon atoms, at an ionic salt forming temperature of not less than 85° C. for a time sufficient for the amine and the dithiophosphoric acid to react and form an ionic salt.

10. The fuel mixture of claim 9, wherein the hydrocarbyl groups are alkyl groups.

11. The fuel mixture of claim 9, wherein the hydrocarbyl substituted group is an alkyl group containing nitrogen, sulfur or oxygen.

12. The fuel mixture of claim 11, wherein the alkyl group containing nitrogen, sulfur or oxygen contains a carbinol, thio, amine, amide, ester or ether group.

13. The fuel mixture of claim 10, wherein $R_4$ and $R_5$ are selected from hydrogen and an alkyl group containing from 4 to 12 carbon atoms.

14. The mixture of claim 9, wherein the primary amine is tallow amine.

15. The mixture of claim 9, wherein the primary amine is a dihydrogenated tallow amine.

16. The mixture of claim 9, wherein the ionic salt forming temperature is from 85° C. to 140° C.

17. A method for reducing smoke emitted from a two-cycle internal combustion engine by operating the engine with the mixture of claim 9.

* * * * *